US006714142B2

(12) United States Patent
Porter et al.

(10) Patent No.: US 6,714,142 B2
(45) Date of Patent: Mar. 30, 2004

(54) PROXIMITY SIGNALING SYSTEM AND METHOD

(76) Inventors: Rhonda Porter, 19422 Lawson Rd., Little Rock, AR (US) 72210; Hirak C. Patangia, 35 Overlook Dr., Little Rock, AR (US) 72207

( * ) Notice: Subject to any disclaimer, the term of this patent is extended or adjusted under 35 U.S.C. 154(b) by 28 days.

(21) Appl. No.: 10/039,593

(22) Filed: Dec. 31, 2001

(65) Prior Publication Data

US 2003/0122684 A1 Jul. 3, 2003

(51) Int. Cl.[7] ..... G08G 1/123
(52) U.S. Cl. ..... 340/988; 340/996; 701/200
(58) Field of Search ..... 340/988, 991, 340/994, 996; 701/200, 213

(56) References Cited

U.S. PATENT DOCUMENTS

| | | | |
|---|---|---|---|
| 4,297,672 | A | 10/1981 | Fruchy et al. |
| 4,325,057 | A | 4/1982 | Bishop |
| 4,350,969 | A | 9/1982 | Greer |
| 4,713,661 | A | 12/1987 | Boone et al. |
| 5,021,780 | A | 6/1991 | Fabiano et al. |
| 5,144,301 | A | 9/1992 | Jackson et al. |
| 5,400,020 | A | 3/1995 | Jones et al. |
| 5,483,234 | A | 1/1996 | Carreel et al. |
| 5,483,454 | A | 1/1996 | Lewiner et al. |
| 5,493,295 | A | 2/1996 | Lewiner et al. |
| 6,006,159 | A | 12/1999 | Schmier et al. |
| 6,184,802 | B1 | 2/2001 | Lamb |

*Primary Examiner*—John Tweel
(74) *Attorney, Agent, or Firm*—Mark Murphey Henry

(57) ABSTRACT

A proximity signaling system and method are disclosed in which first and second transmitters are disposed on first and second mobile objects. The first and second transmitters generate first and second RF signals with first and second receiver addresses, respectively. A receiver is disposed remotely from the first and second transmitters. The receiver has a first and second microcontroller decoders for recognizing the first and second RF signals, respectively. The receiver has a gradual proximity display, such as a bar graph display, for indicating signal strength. The receiver also has first and second proximity alerts, such as lights, beepers, or voice chips, for signaling proximity of the first and second objects, respectively. In use, the first microcontroller decoder filters signals received by the receiver and passes only signals having the first receiver address along to the display and alerts. Similarly, the second microcontroller decoder filters signals received by the receiver and passes only signals having the second receiver address along to the display and alerts. A microphone may be incorporated into the receiver so that a user may record different custom messages for announcing the proximity of different approaching objects.

20 Claims, 7 Drawing Sheets

PROXIMITY SIGNALING SYSTEM AND METHOD

BACKGROUND OF THE INVENTION

The present invention relates to proximity signaling systems and more particularly to proximity signaling systems for alerting a user of an approaching vehicle.

School buses and similar mass transit systems often require school children or passengers to wait at appointed stops for a particular bus to arrive. For several reasons, it is typically desirable to reduce the amount of time that a passenger must spend at an appointed stop waiting for transportation. For example, for the safety and comfort of school children, it is desirable to reduce the amount of time they must spend waiting for a school bus alone, with other children, or in inclement or adverse weather conditions. This holds true regardless of whether the child is waiting to be picked up by the school bus or waiting to be picked up by a parent or other responsible adult after being dropped off by a school bus. As another example, it is simply desirable to make more efficient use of ones time by reducing the amount of time wasted waiting on a bus or other transportation.

There have been a number of attempts at providing early warning systems to alert users of approaching buses, and a number of different approaches have been taken. A few examples include the systems disclosed in U.S. Pat. No. 4,350,969, issued to Greer in 1982, U.S. Pat. No. 5,021,780, issued to Fabiano et al. in 1991, U.S. Pat. No. 5,144,301, issued to Jackson et al. in 1992, and U.S. Pat. No. 6,006,159, issued to Schmier et al in 1999. The disclosures of these references are incorporated herein by reference. Prior attempts have offered some advantages but still suffer from a number of disadvantages. For example, the receivers used in these systems typically lack flexibility regarding how they receive and process signals and in how they provide information to users. Also, the systems that are disclosed in these references are typically not well suited for school bus transportation systems. For example, some receivers may not be used to signal the approach of multiple buses. Some systems require significant setup, such as requiring that the location of all stops be predetermined. Other systems require a driver to take action at each stop to update the transmitted signal. These systems typically offer too little flexibility, require too much set-up, and introduce too many chances for error.

SUMMARY OF THE INVENTION

It is therefore an object of the present invention to provide a flexible proximity signaling system and method particularly suited for use in providing early warning of the approach of a bus or other vehicle.

It is a further object of the present invention to provide a system and method of the above type that allows a single receiver to be used to identify and alert users of the approach of two different buses or vehicles.

It is a still further object of the present invention to provide a system and method of the above type that is very user friendly and requires very little set-up.

It is a still further object of the present invention to provide a system and method of the above type that eliminates the need for detailed mapping of a bus route.

It is a still further object of the present invention to provide a system and method of the above type that eliminates the need for a transmitted signal to be updated or changed as a bus travels its route.

It is a still further object of the present invention to provide a system and method of the above type that eliminates the need for a driver to take affirmative actions to update or change the transmitted signal as the bus travels over its route.

It is a still further object of the present invention to provide a system and method of the above type that allows a bus to vary from its usual route without introducing error into the system.

It is a still further object of the present invention to provide a system and method of the above type that uses signal strength to progressively trigger a variety of alerts.

It is a still further object of the present invention to provide a system and method of the above type that provides a gradual proximity display for incrementally displaying the approach of a bus.

It is a still further object of the present invention to provide a system and method of the above type that uses a voice chip to provide a message that helps a user to determine which bus is approaching.

It is a still further object of the present invention to provide a system and method of the above type that uses a voice chip and that allows a user to customize one or more messages to be used to alert a user when one or more buses are approaching.

It is a still further object of the present invention to provide a system and method of the above type that uses receiver addresses to distinguish signals sent by different buses.

Toward the fulfillment of these and other objects and advantages, a system is disclosed in which first and second transmitters are disposed on first and second mobile objects. The first and second transmitters generate first and second RF signals with first and second receiver addresses, respectively. A receiver is disposed remotely from the first and second transmitters. The receiver has first and second microcontroller decoders for recognizing the first and second RF signals, respectively. The receiver has a gradual proximity display, such as a bar graph display, for indicating signal strength. The receiver also has first and second proximity alerts, such as lights, beepers, or voice chips, for signaling proximity of the first and second objects, respectively. In use, the first microcontroller decoder filters signals received by the receiver and passes only signals having the first receiver address along to the display and alerts. Similarly, the second microcontroller decoder filters signals received by the receiver and passes only signals having the second receiver address along to the display and alerts. A microphone may be incorporated into the receiver so that a user may record different custom messages for announcing the proximity of different approaching objects.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
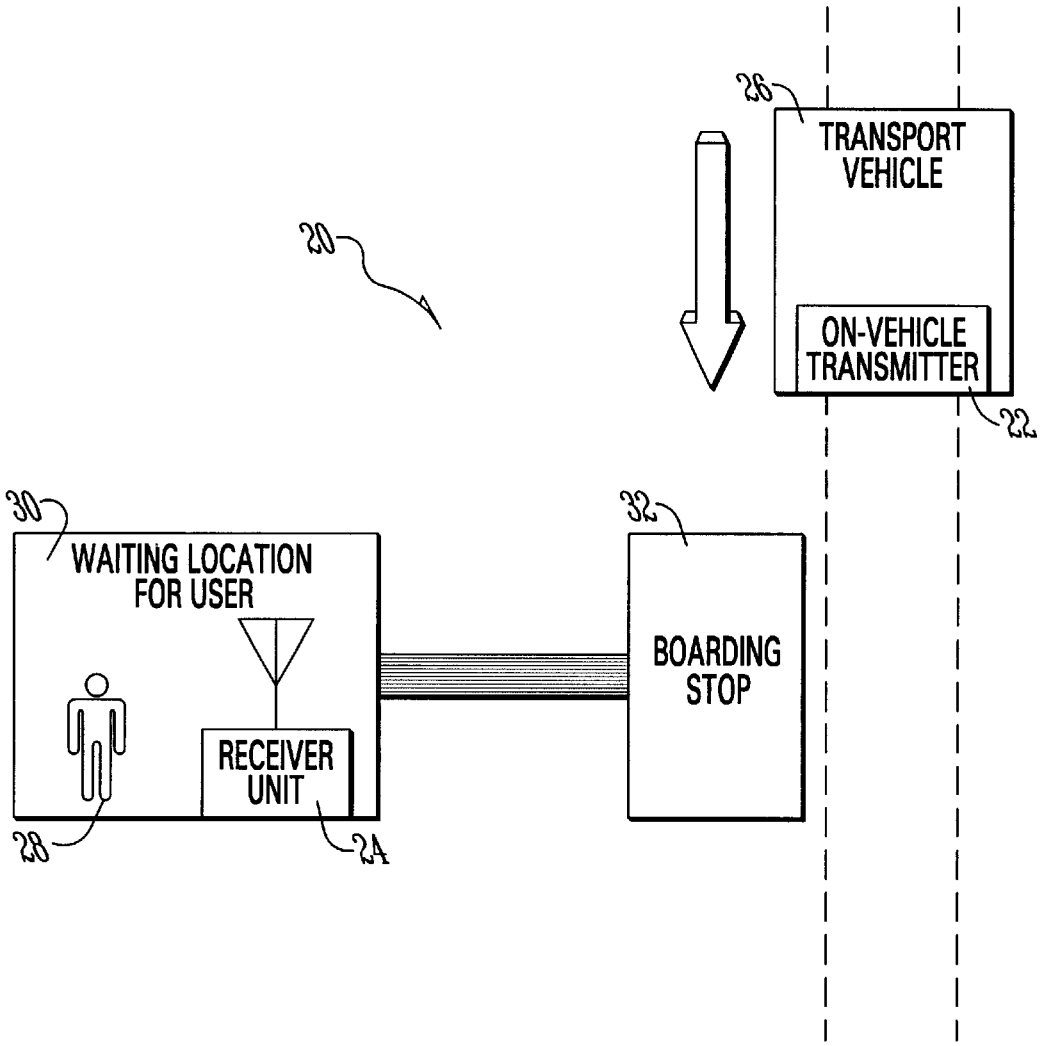
FIG. 1 is a schematic of a proximity signaling system of the present invention.

Referring to FIG. 1, the reference numeral 20 refers in general to a proximity signaling system of the present invention. The system and method generally involve the use of one or more transmitters 22 and receivers 24, as described in more detail below, to signal the approach of one or more mobile objects 26, such as buses. The system 20 is particularly useful for alerting a user 28 waiting at a location 30 when a bus 26 approaches a boarding stop 32.

Figure 2:
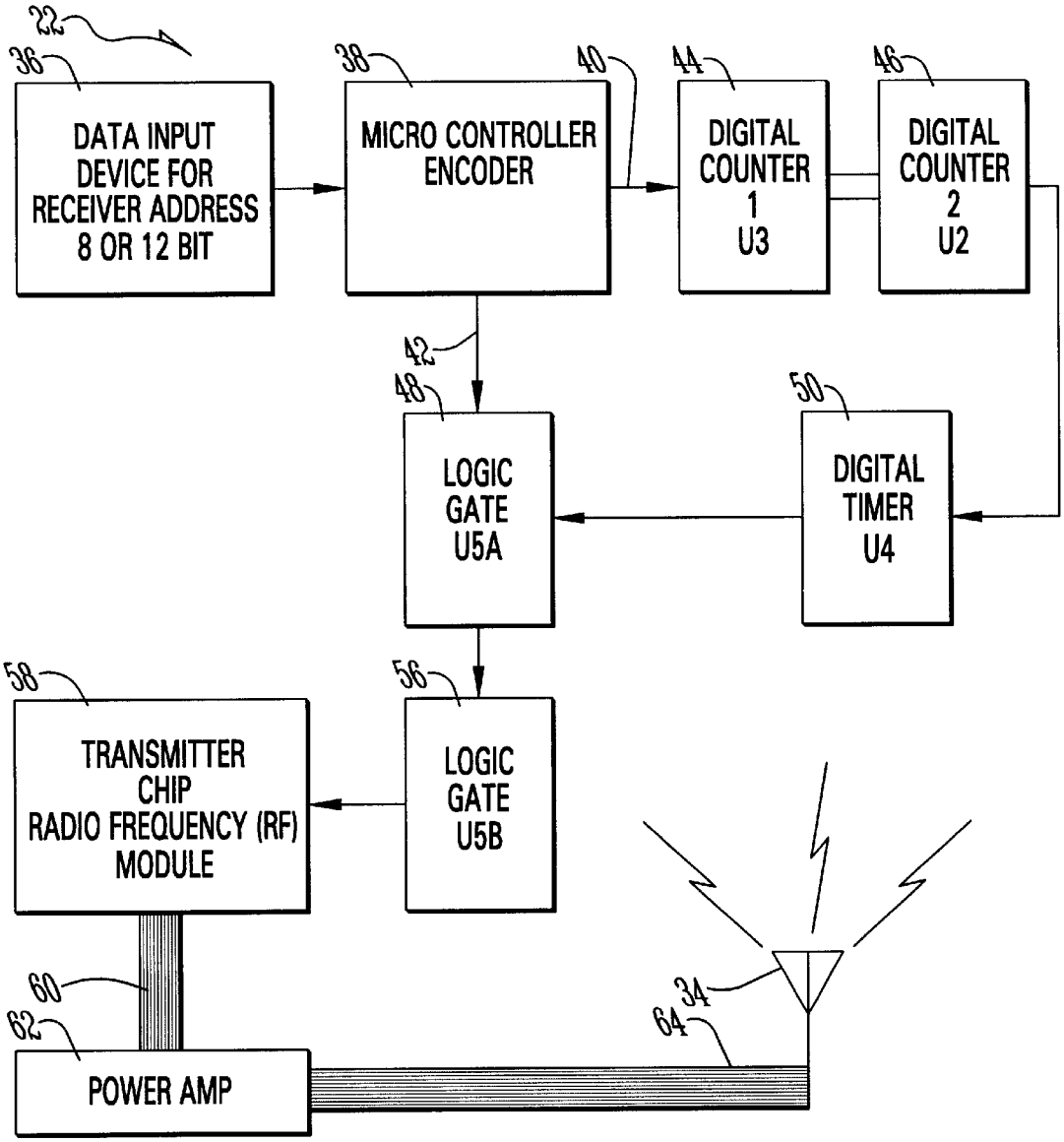
FIG. 2 is a block diagram of a transmitter for use in a system of the present invention.
Figure 3:
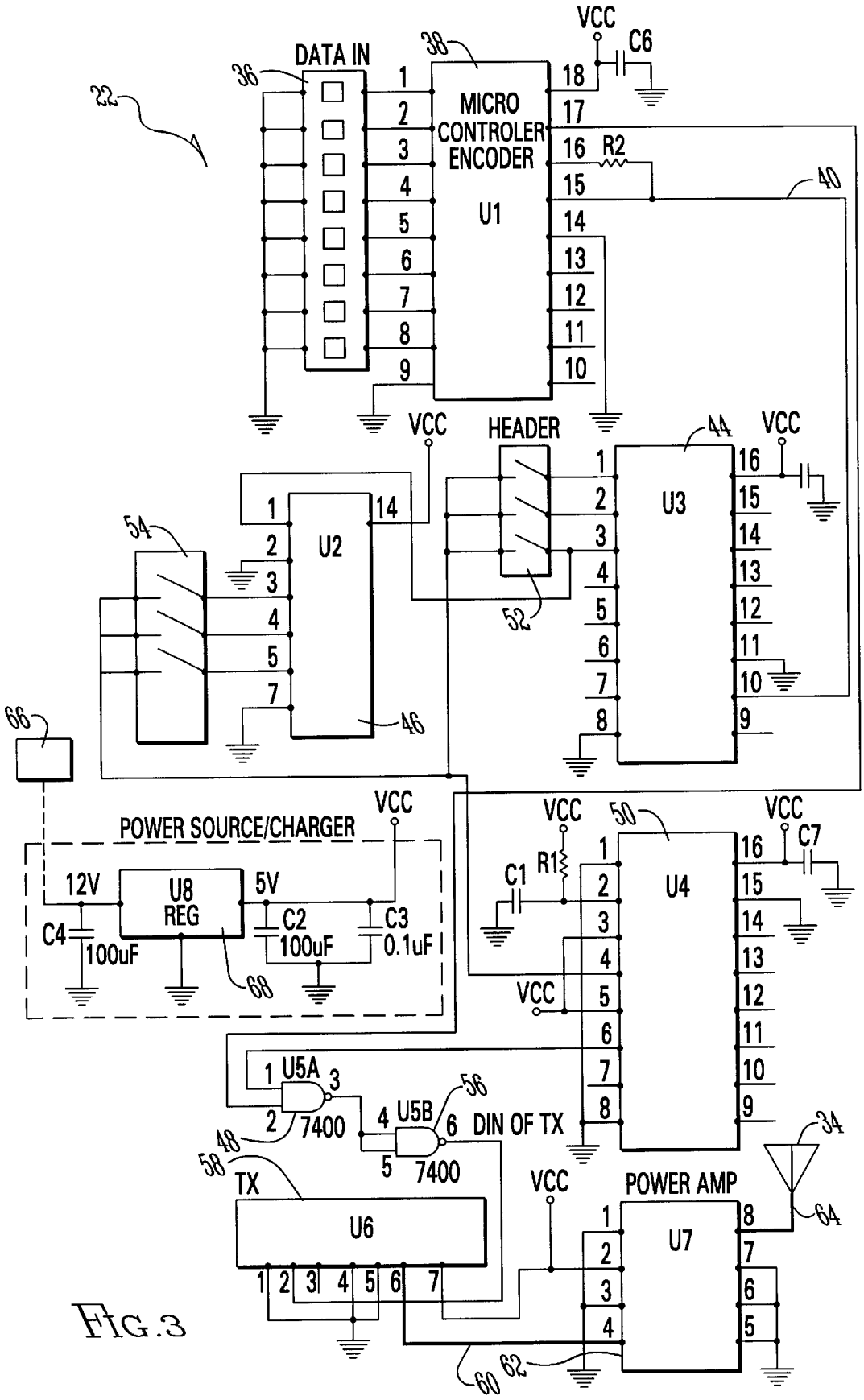
FIG. 3 is a circuit schematic of a transmitter for use in a system of the present invention.

As best seen in FIGS. 2 and 3, the transmitter 22 is used to generate RF signal data having a designated receiver address and to send the data through antenna 34. An 8 bit or 12 bit adjustable data input device 36 provides a selected receiver address in binary code. The 8 bit DATA IN configuration will support up to 256 sets of unique addresses, whereas the 12 bit configuration will support up to 4096 unique addresses. For most applications, an 8 bit configuration will be able to provide more receiver addresses than needed. Still, if more addresses are needed, a 12 bit configuration is available. The data can be inputted through a series of on/off switches 36 for flexibility, or it can be hard-wired. The switches will allow a user 28 to set the receiver address in binary code. Hard-wiring would reduce the flexibility of the transmitter 22 but would simplify construction and eliminate the need for the switches 36. The data from the data input device 36 is encoded by a microcontroller encoder 38. The outputs 40 and 42 of the encoder 38 are then divided into packets of data providing electrical inputs to digital counters 44 and 46 and logic gate 48. Digital counter 44 works in conjunction with digital counter 46 to provide an input to digital timer 50. Although headers 52 and 54 (FIG. 3) may be used, in the preferred embodiment, headers 52 and 54 are unnecessary. Data packet output from the digital timer 50 joins the microcontroller encoder output 42 as the first and second inputs, respectively, to logic gate 48.

The intermittent data output of the logic gate 48 provides both inputs to another logic gate 56, whose output feeds directly into a transmitter chip/radio frequency (RF) module 58, where it is modulated with a carrier frequency at the VHF/UHF range. The design will vary depending upon the carrier frequency selected for transmission. The modulation method used in this preferred embodiment is amplitude shift keying (ASK), and some transmitters 22 may employ frequency shift keying (FSK) modulation. The RF module 58 sends the modulated data output through microstrip 60, into a power amplifier 62. The power amplifier 62 amplifies the modulated data and radiates it through microstrip 64 into the transmission antenna 34 for transmission to receivers 24 located at homes, offices, or other convenient waiting places 30 of users 28. Microstrips 60 and 64 are strips of copper designed for impedance matching to facilitate efficient transmission of the RF signal. Without the microstrips 60 and 64, the RF signal loss would be significant. The antenna 34 is preferably a half-wave whip style antenna, and the RF signal data is transmitted in the form of electromagnetic waves.

Referring to FIG. 3, in one embodiment, the transmitter 22 is powered by the vehicle's battery 66. The transmitter 22 will receive 12V of DC voltage from the vehicle battery 66, and a regulator 68 will regulate the voltage to 5V or 3V depending on the chip requirements. The transmitter 22 may also have a rechargeable power source, such as using a rechargeable battery. Using transmitter 22 with an independent power supply could add to the flexibility and ease of use of the transmitter 22, eliminating the need for wiring the transmitter 22 to a vehicle battery 66. This would make it easier to move a transmitter 22 from one vehicle 26 to the next and would minimize concerns about vehicle notification when vehicle power fails. Of course, the transmitter 22 may be powered by the vehicle's battery 66 and still have separate battery backup power.

Figure 4:
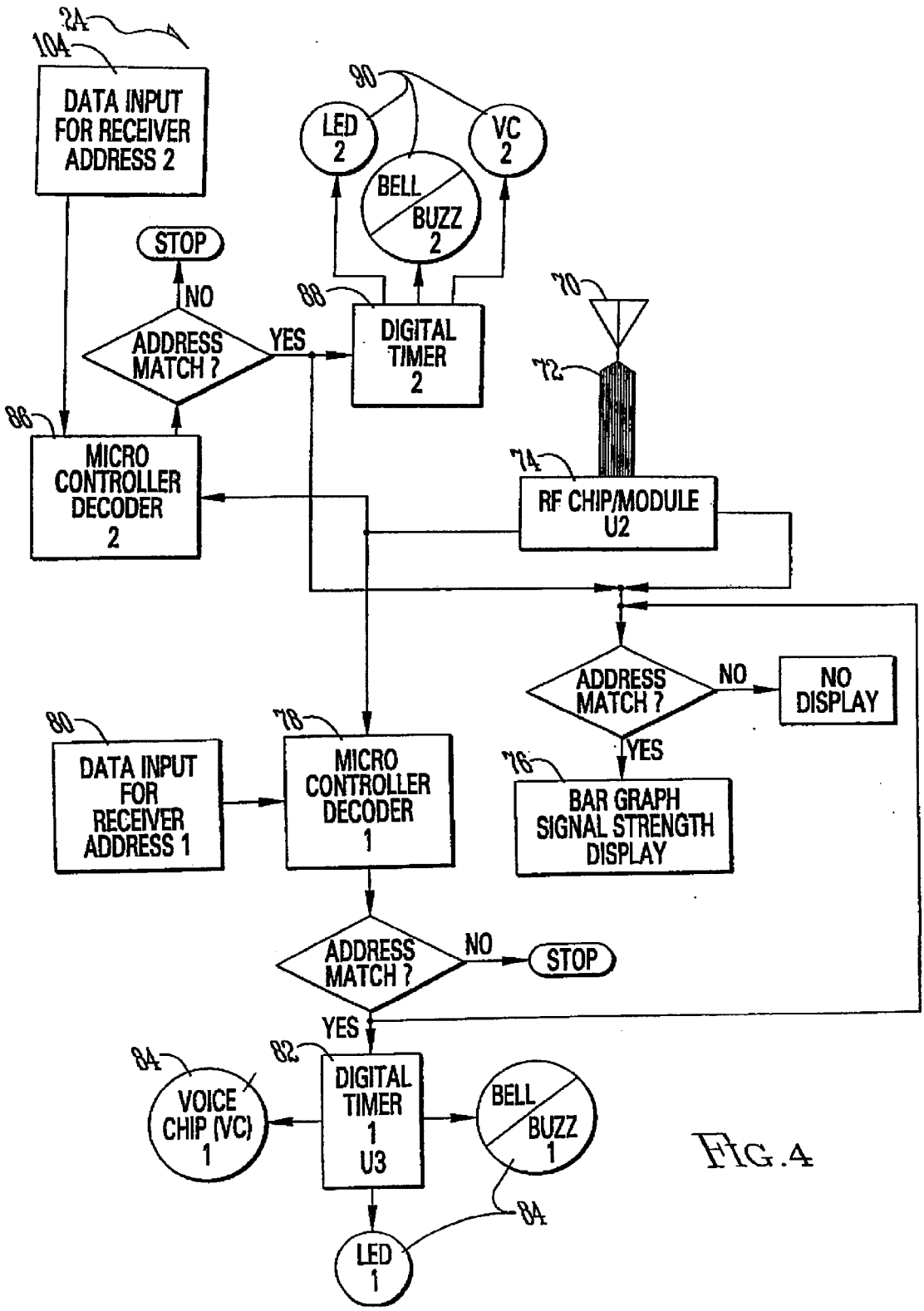
FIG. 4 is a block diagram of a receiver for use in a system of the present invention.
Figure 5:
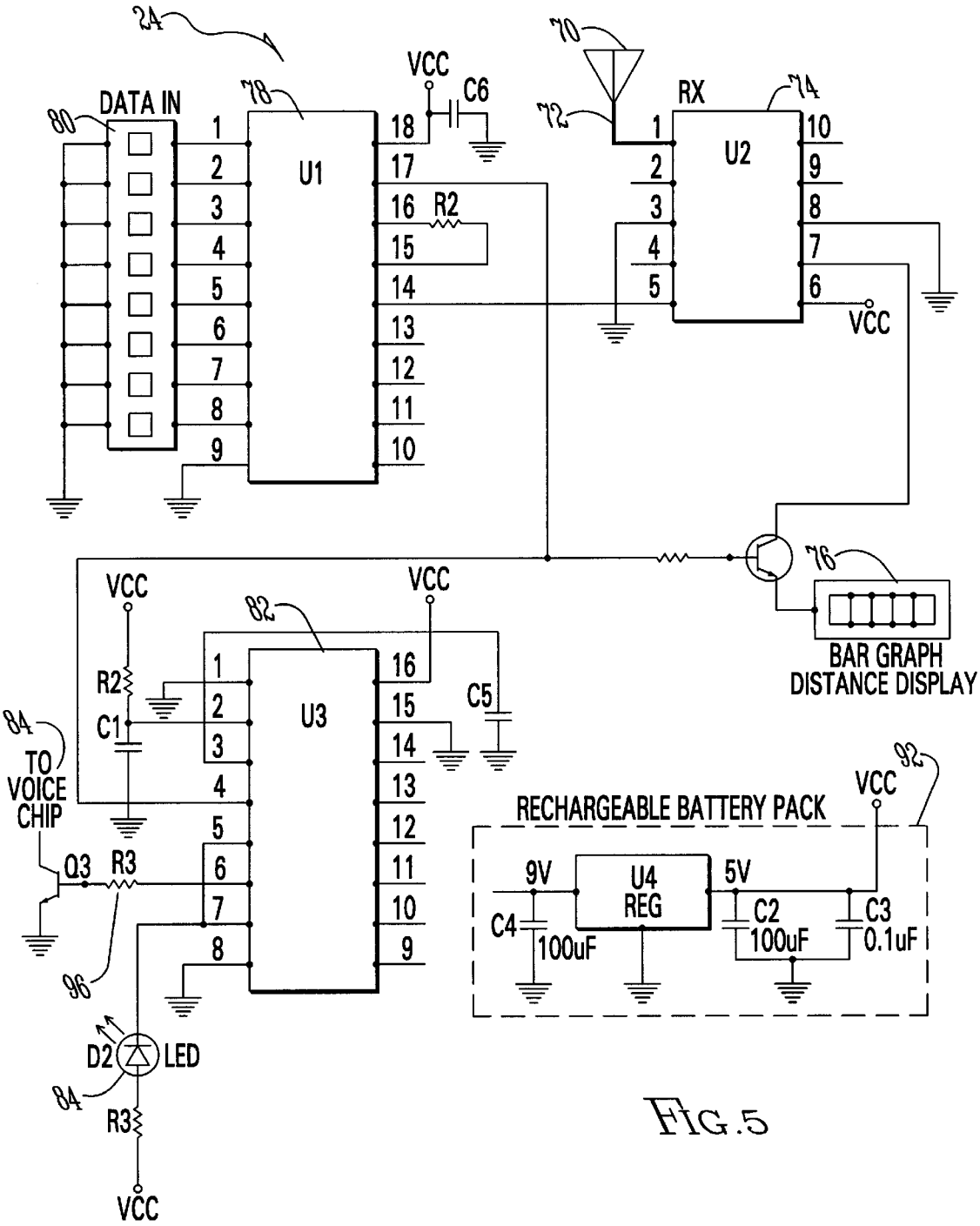
FIG. 5 is a circuit schematic of a receiver for use in a system of the present invention.

The receiver 24 of the present invention typically performs three basic functions: it receives and verifies the transmitted RF signals from transmitters 22 within range; it displays the gradual proximity of a transmitter 22 to the receiver 24; and it notifies the user 28 of a desired vehicle's 26 pending arrival when the signal reaches a predetermined strength. As best seen in FIGS. 4 and 5, an antenna 70 receives a modulated signal from one or more transmitters 22. The modulated signal is fed from the antenna 70 through microstrips 72 to a RF chip/module 74. The RF chip/module 74 demodulates the received signal and reconditions it to recover the encoded data. The RF chip/module 74 sends the reconditioned signal to a gradual proximity display 76 to provide a visual representation of the signal strength, thereby providing an approximation of the distance between the transmitter 22 and receiver 24. Although the RF signal strength provides a fair approximation of the distance between the transmitter 22 and receiver 24, RF reception and signal strength is dependent upon a number of factors, including terrain and weather conditions. The gradual proximity display may be calibrated, and a user 28 may adjust the sensitivity of the receiver 24 to accommodate for variances.

The RF chip/module 74 also sends the reconditioned signal to a microcontroller decoder 78 where it is decoded. The receiver address of the signal is compared to one or more selected receiver addresses for a match. A user 28 inputs the data concerning the desired receiver address using a series of on/off switches 80. These switches 80 set the receiver address in binary code. The switches 80 will typically be set by turning a dial or setting switches to one or more desired numbers that corresponds with one or more numbers assigned to one or more desired buses 26 or route. When there is no match, the decoder 78 does not pass the signal along for further processing. When there is a matching address, the decoder 78 sends a signal to a digital timer 82 that can activate one or more proximity alerts 84. The signal to the gradual proximity display 76 may also be routed through the decoder 78 so that gradual proximity display 76 will only be activated by buses 26 having one or more desired receiver addresses.

The embodiment depicted in FIG. 4 has a second microcontroller decoder 86 so that the receiver 24 may be used to signal the proximity of a second vehicle 26 having a transmitter 22 broadcasting a signal with a different receiver address. It may be possible to provide a decoder 78 or 86 that is capable of screening for two or more different receiver addresses. For the sake of cost and simplicity of design, it is preferred to use a separate decoder 78 or 86 to screen for each separate receiver address desired. Similarly, it may be possible to use common digital timers 82 or 88 and proximity alerts 84 or 90, but for the sake of cost and simplicity of design, it is preferred to use separate digital timers 82 and 88 and proximity alerts 84 and 90 for each separate receiver address to be monitored.

Proximity alerts 84 and 90 may take any number of forms, and different combinations of proximity alerts may be used. A proximity alert 84 or 90 may use any number of different visual signals, including but not limited to one or more lights that emit continuous or flashing light, an LED display, a bar graph, and the like. Similarly, a proximity alert 84 or 90 may use any number of different audio signals, including but not limited to bells, buzzers, beepers, horns, recorded messages, and the like. The system of the present invention typically uses a combination of visual and audio alerts or signals.

The embodiment depicted in FIG. 5 uses a rechargeable battery pack 92 to power the receiver 24. This adds to the mobility and flexibility of the receiver 24. This also minimizes vulnerability to problems that might be caused by power outages. Of course, the receiver 24 may be powered by any conventional means, and may include a plug for plugging into a home's existing electrical system. Of course, the transmitter 22 may have multiple power sources, including battery backup power.

Figure 6:
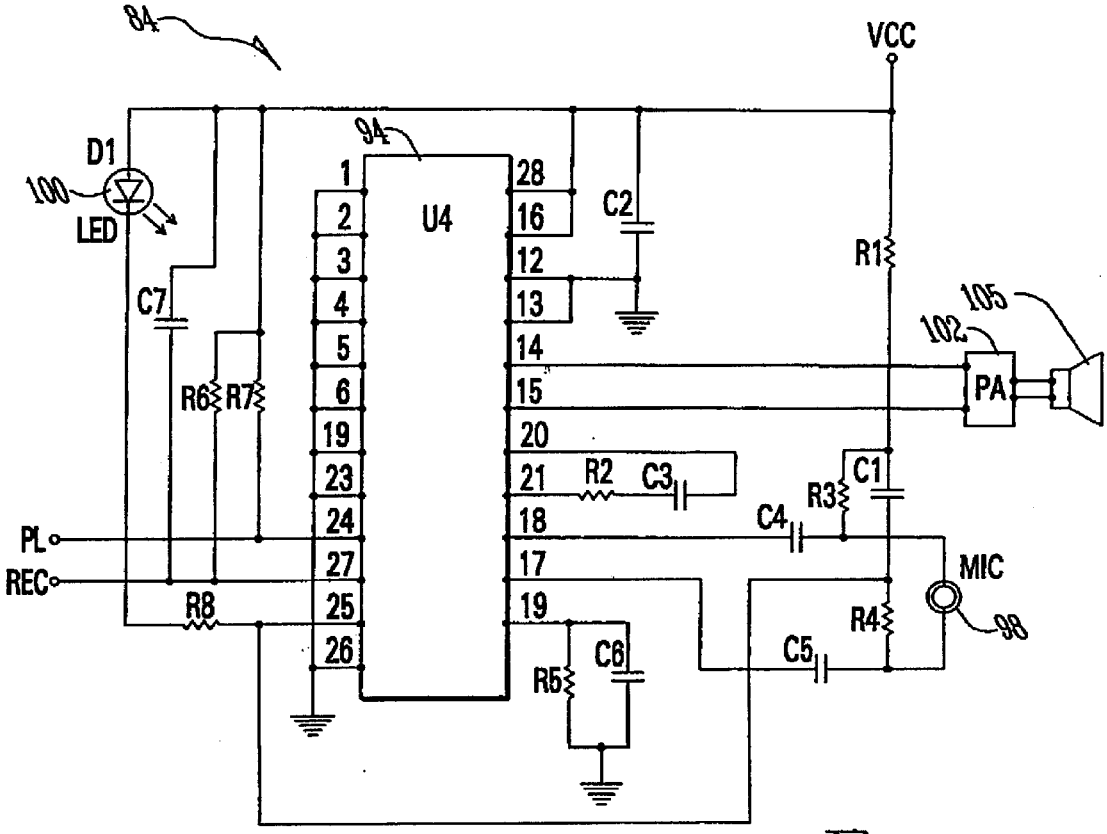
FIG. 6 is a circuit schematic of a voice chip for use in a system of the present invention.

As best seen in FIGS. 5 and 6, input to the voice chip 94 is derived from the drive transistor 96, which is driven from the digital timer 82. A microphone 98 is preferably provided for recording customized messages. For example, in homes 30 with two or more children 28 riding two or more different school buses 26, different messages could be recorded to call out the appropriate child's 28 name when that child's bus 26 is approaching. The voice chip 94 also has an LED display 100 to indicate when the message has been played. This feature is helpful in case a user 28 is hearing impaired or is simply out of hearing range when the message is initially played. When activated, the voice chip 94 transmits the appropriate message to a power amplifier 102 and to speaker 105. The voice chip 94 is activated when a signal having the desired receiver address reaches a desired signal strength. Once activated, the voice chip 94 may be deactivated in any number of ways. For example, the voice chip 94 may play the message once or any preset number of times, the voice chip 94 may repeat the message until the signal strength falls below a desired value, the voice chip 94 may repeat the message for a preset time period, or the voice chip 94 may repeat the message until manually deactivated.

In use, each bus 26 or each route in a desired system is assigned a number that corresponds with a particular receiver address. A transmitter 22 is placed on a bus 26, and a dial or series of switches 36 on the transmitter 22 are manually set to the number assigned to that bus 26 or that route. The switches 36 set the data input to generate a desired receiver address. A user 28 has a receiver 24 at a desired location 30 such as at home. The user 28 sets one or more dials or series of switches 80 and 104 on the receiver 24 to correspond with the numbers assigned to the desired buses 26 or routes.

When a driver begins his route, he checks to make sure that the transmitter 22 is set to the proper number assigned to his bus 26 or route, and he turns on the transmitter 22. The transmitter 22 generates and transmits a signal having a particular receiver address. The transmitter 22 continues transmitting this signal as the bus 26 travels along its route. The signal being generated and transmitted is not dependent on where the bus 26 is located along the course of its route, on how many stops 32 the bus has passed, or on how far the bus 26 has traveled. Similarly, the driver is not required to input any additional information into or via the transmitter 22 as the bus 26 travels over its route. This reduces the risk of human error, such as the risk that an inexperienced driver might enter erroneous information or the risk that a distracted driver may simply forget to input required information at one of many stops 32. Similarly, the transmitter 22 does not process information obtained mechanically, such as mileage information from a bus odometer. This also reduces the risk of mechanical and human error. If the transmitted signal depends upon data from an odometer, forgetting to reset an odometer or deviating slightly from a set route could lead to the transmission of erroneous data.

The signal that is generated and sent by the transmitter 22 preferably has a frequency of approximately 413 MHz to approximately 418 MHz. It is of course understood that any number of different frequencies may be used as desired or as may be required by the FCC. It may typically be picked up and recognized by a receiver 24 at distances of up to approximately 1 mile. The receiver 24 receives the signal and processes it to determine whether it has one or more desired receiver addresses. If the signal is from one of the selected buses 26 or routes, the receiver address will match the preset receiver addresses set at the receiver 24, and the receiver 24 will further process the signal. The gradual proximity display 76 provides a visual display representing the approach of a bus 26. The receiver 24 may be designed so that the gradual proximity display 76 may be actuated by any transmitter 22 or may be actuated only by transmitters 22 emitting signals having the desired receiver addresses.

Figure 7:
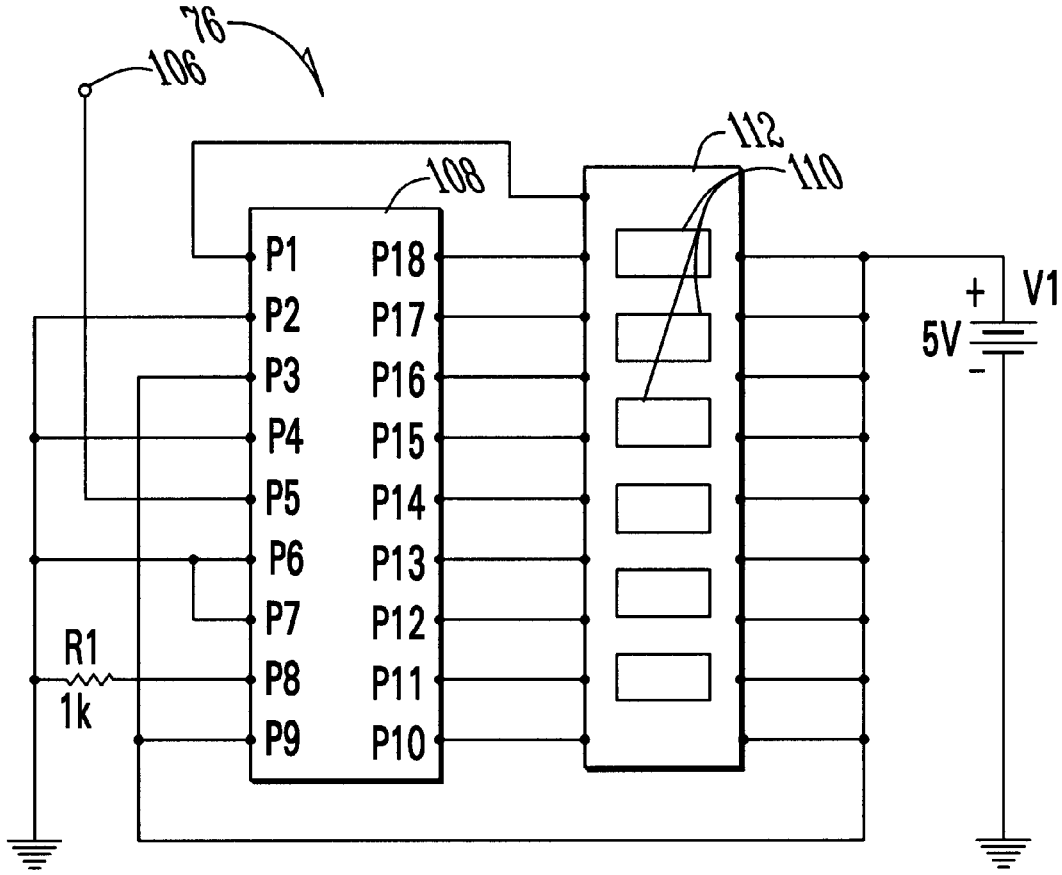
FIG. 7 is a circuit schematic of a bar graph display for use in a system of the present invention.

When the receiver 24 receives a signal having a desired receiver address, the receiver 24 processes and monitors the signal. When the monitored signal reaches a desired signal strength, the gradual proximity display 76 is activated. As one example, the gradual proximity display 76 may be a series of lights that come on as the signal strength reaches predetermined levels, indicating that the bus 26 is approaching. The series of lights may be lit, for example, as follows: a first light may be lit when the signal strength reaches a level indicating that the bus 26 is approximately 1 mile from the receiver 24, a second light may be lit when the signal strength reaches a level indicating that the bus 26 is approximately ½ mile from the receiver 24, and a third light may be lit when the signal strength reaches a level indicating that the bus 26 is approximately ¼ mile from the receiver 24. The gradual proximity display 76 may take any number of forms, such as a bar graph display in which the display adds or deletes bars as the signal strength increases. A preferred bar graph display is depicted in FIG. 7. As seen in FIG. 7, signal strength data is received at input 106. The signal strength data is processed by driver 108 which controls the lights 110 in bar graph 112. The proximity alert 84 or 90 may be set so that it is activated at the same signal strength as the third light or at some other signal strength as desired.

In one preferred embodiment, the proximity alert 84 or 90 is a voice chip 94 with one or more pre-recorded custom messages. In this embodiment, when a signal with a desired receiver address reaches a desired signal strength, the voice chip 94 is activated to play the message, such as calling the name of the appropriate child 28 or calling the name of the bus 26, or of the school or route associated with the approaching bus 26. When the voice chip 94 is activated, an LED display 100 is also activated to give visual confirmation that the audio alert has been sounded. It is of course understood that any number of different combinations of proximity alerts 84 and 90 may be used, including but not limited to different combinations of light and sound alerts.

Although RF signal strength provides a fairly accurate approximation of distance, it is dependent upon a number of factors, including terrain and weather conditions. To offset possible variances, the user 28 may adjust the sensitivity of the receiver 24 to provide the various alerts at desired signal strengths. This allows a user 28 to in effect calibrate the receiver 24 for his or her particular location 30. Similarly, different homes or waiting locations 30 will typically be located different distances from the various boarding stops 32 along a route. It will therefore typically take different users 28 different amounts of time to travel from theirs homes 30 to their boarding stops 32. Allowing a user 28 to adjust the sensitivity of the receiver 24 provides added flexibility, allowing a user 28 to receive more or less advance warning as needed or desired.

The system and method of the present invention may be used in the morning, when one or more children 28 are waiting to be picked up by one or more buses 26, and in the evening, when a parent 28 is waiting for one or more children to be dropped off by one or more buses 26.

The system and method of the present invention offer a number of advantages. For example, a receiver 24 of the present invention may signal the approach of multiple buses 26. The gradual proximity display 76 provides a continuous display of signal strength, which provides a good, real-time approximation of the distance between the bus 26 and the receiver 24. The voice chip 94 provides added flexibility for audibly announcing the approach of one or more school buses 26. The use of batteries to power the transmitters 22 and receivers 24 adds to the flexibility and ease of use of the system 20. Further because the system 20 uses many digital components, rather than analog components, the system is less prone to make notification errors.

Although the above discussion relates primarily to using the system and method for notifying school children 28 of an approaching school bus 26, it is understood that the system and method may have any number of different uses. For example, the present invention may be adapted for use with a wide variety of vehicles 26, including but not limited to taxis, company transportation such as trams, day care vans, boats, trains, subway trains, rail cars, trolleys or similar vehicles. The system 20 could be adapted to allow for the notification of potential passengers 28 using a paging system. The system could also be adapted to provide early notification of the approach of other vehicles 26, including but not limited to vehicles used by spouses, older children, delivery services, postal services, housekeeping services, lawn care services, or any of a wide variety of services. Further, the system could be integrated into a home or business and programmed to automatically perform various tasks that are part of a daily or periodic routine. For example, the system could be used to turn off alarm systems, turn on lights, unlock doors, open gates or garage doors, or start a car engine when a transmitter 22 with the appropriate receiver address approaches a receiver 24.

Other modifications, changes, and substitutions are intended in the foregoing, and in some instances, some features of the invention will be employed without a corresponding use of other features. For example, any number of different proximity alerts 84 and 90 may be used in any number of different combinations. Similarly, any number of different decoders 78 and 86 may be used in the receiver 24, and different decoders 78 and 86 may be used activate the same or any number of different combinations of proximity alerts 84 and 90. Further, different proximity alerts 84 and 90 and different combinations of proximity alerts may be activated by different transmitter signals, and some may be activated regardless of the receiver address of the transmitter 22. Further still, any number of different ways may be used to generate and transmit signals having desired receiver addresses and to check received signals to see if they match receiver addresses set at the receiver 24. Further, the receiver address data may be input into the transmitter 22 and into the receiver 24 in any number of different ways. Also, the signal may be encoded, sent, and decoded in any number of different ways. It is understood that all quantitative information are given by way of example only and are not intended to limit the scope of the invention. Accordingly, it is appropriate that the appended claims be construed broadly and in a manner consistent with the scope of the invention.

What is claimed is:

1. A combination, comprising:

a first transmitter disposed on a first mobile object, said first transmitter generating a first RF signal with a first receiver address;

a second transmitter disposed on a second mobile object, said second transmitter generating a second RF signal with a second receiver address; and a receiver disposed remotely from said first and second transmitters, said receiver comprising:

a first microcontroller decoder for recognizing said first RF signal;

a second microcontroller decoder for recognizing said second RF signal;

a first gradual proximity display for indicating signal strength of said first RF signal;

a first proximity alert for signaling proximity of said first object; and a second proximity alert for signaling proximity of said second object.

2. The combination of claim 1, wherein said first proximity alert comprises:

a voice chip, said voice chip being operably connected to said first microcontroller decoder to provide a first message to indicate proximity of said first object.

3. The combination of claim 2, wherein said first proximity alert further comprises:

a microphone operably connected to said voice chip for recording said first message.

4. The combination of claim 1, wherein said first gradual proximity display comprises a bar graph signal strength display.

5. The combination of claim 4, wherein said first proximity alert comprises a light alert and a sound alert.

6. The combination of claim 1, wherein said receiver further comprises:

an antenna;

a RF chip module for demodulating and reconditioning a signal received from said antenna; and a microstrip operably connecting said antenna and said RF chip module.

7. The combination of claim 1, wherein said first transmitter comprises:

an 8 or 12 bit data input device;

a microcontroller encoder;

a digital counter operably connected to said microcontroller encoder;

a digital timer operably connected to said digital counter;

a first logic gate operably connected to said microcontroller encoder and to said digital timer;

a second logic gate operably connected to said first logic gate;

a transmitter chip operably connected to said second logic gate;

a power amp operably connected to said transmitter chip; and an antenna operably connected to said power amp.

8. The combination of claim 7, wherein:

said power amp is operably connected to said transmitter chip by a first microstrip; and said antenna is operably connected to said power amp by a second microstrip.

9. The combination of claim 1 wherein said first and second mobile objects comprise first and second buses.

10. A combination, comprising:

a first transmitter disposed on a first mobile object, said first transmitter generating a first RF signal with a first receiver address; and a receiver disposed remotely from said first transmitter, said receiver comprising:

a first microcontroller decoder for recognizing said first RF signal;

a first gradual proximity display for indicating signal strength of said first RF signal; and a voice chip, said voice chip being operably connected to said first microcontroller decoder to provide a first message to indicate proximity of said first object.

11. The combination of claim 10 wherein said receiver further comprises:

a microphone operably connected to said voice chip for recording said first message.

12. The combination of claim 10, wherein said first gradual proximity display comprises a bar graph signal strength display.

13. The combination of claim 10, wherein said first gradual proximity display is operably connected to said first microcontroller decoder to provide a display to indicate proximity of said first object.

14. The combination of claim 10 wherein said first mobile object comprises a bus.

15. A method, comprising:

(a) placing a first transmitter on a first mobile object;

(b) placing a second transmitter on a second mobile object;

(c) generating and transmitting a first signal having a first receiver address from said first transmitter;

(d) generating and transmitting a second signal having a second receiver address from said second transmitter;

(e) providing a receiver, disposed remotely from said first and second mobile objects, said receiver comprising a first decoder, a first gradual proximity display, and a first proximity alert;

(f) providing signals received by said receiver to said first decoder;

(g) filtering said received signals through said first decoder so that said first decoder allows only said signals having said first receiver address to pass to said first proximity alert.

16. The method of claim 15, wherein said receiver further comprises a second decoder and a second proximity alert, and further comprising:

filtering said received signals through said second decoder so that said second decoder allows only said signals having said second receiver address to pass to said second proximity alert.

17. The method of claim 15, further comprising:

actuating said first proximity alert when said receiver receives said first signal at a first signal strength; and actuating said first gradual proximity display when said receiver receives said first signal at a second signal strength.

18. The method of claim 16, further comprising:

actuating said second proximity alert when said receiver receives said second signal at a first signal strength; and actuating said first gradual proximity display when said receiver receives said second signal at a second signal strength.

19. The method of claim 15, wherein said first proximity alert comprises a voice chip, and further comprising recording a first custom message for replay by said first voice chip.

20. The method of claim 15, wherein step (a) comprises placing said first transmitter on a first bus.

* * * * *